United States Patent [19]

Minihane

[11] 4,067,123

[45] Jan. 10, 1978

[54] SOLE CONSTRUCTION

[75] Inventor: Robert P. Minihane, Concord, Mass.

[73] Assignee: Hyde Athletic Industries, Inc., Cambridge, Mass.

[21] Appl. No.: 763,729

[22] Filed: Jan. 31, 1977

[51] Int. Cl.[2] ..... A43B 13/06

[52] U.S. Cl. ..... 36/32 R; 36/128

[58] Field of Search ..... 36/28 R, 59 C, 114, 36/126, 128, 129

[56] References Cited

U.S. PATENT DOCUMENTS

| | | | |
|---|---|---|---|
| 2,833,057 | 5/1958 | Hack | 36/59 C |
| 3,593,436 | 7/1971 | Vietas | 36/32 R |
| 3,988,840 | 11/1976 | Minihane | 36/32 R |

*Primary Examiner*—Alfred R. Guest

*Attorney, Agent, or Firm*—Wolf, Greenfield & Sacks

[57] ABSTRACT

An athletic shoe intended for use on a synthetic turf is constructed of a resilient plastic with a sole that has a plurality of cleats uniformly spaced in both the toe area and the heel area of the sole. A plurality of elongated cleats extend about the periphery of the sole except in the toe area. A flange integral with the base of the sole extends away from the side opposite the elongated cleats. The flange is used to secure the sole to the upper.

4 Claims, 4 Drawing Figures

B
A
50
51
52
19
18
36
11
22
20
30
13
15
17
12
14
16
10
32
2
3
4

SOLE CONSTRUCTION

BACKGROUND OF THE INVENTION

The present invention relates, in general, to a cleated athletic shoe. More particularly, this invention is concerned with an improved athletic shoe sole of the type disclosed in my prior U.S. Pat. No. 3,988,840 issued Nov. 2, 1976.

Soles of the type with which this invention is concerned are intended primarily for use on synthetic turf. As pointed out in my previous patent, a design of a sole for use on synthetic surface is not necessarily the same as the design of a sole for use on natural turf. In designing and developing soles for use on synthetic turf the peculiar properties of synthetic surfaces require a great deal of empirical determination and experimentation to determine optimum parameters. Heretofore and exemplified in my prior patent, it has been realized that adequate gripping on synthetic turfs requires maximum frictional interengagement between the sole and the turf. However, certain compromises must be made in order to provide a sole with the necessary integrity and strength required for the abusive use to which these soles are frequently subjected. In addition, certain unobvious modifications are required to improve the efficiency of the soles heretofore in use as exemplified by my prior patent.

Accordingly, an object of the present invention is to provide an improved athletic sole construction designed particularly for use on synthetic turfs. Another object of the present invention is to provide a sole construction for use on synthetic turfs which construction provides greater structural integrity of the sole and in addition provides sole construction which can be secured more firmly to the upper of the athletic footwear.

The improved structural integrity of the footwear is provided by elimination of the peripheral cleats in the toe area and by modifying the foremost of these peripheral cleats. In this connection, it has been determined that elongated peripheral cleats in the toe area, as used in my original patent, will, when subject to substantial abuse, break or wear more readily than the other peripheral cleats. By eliminating the elongated peripheral cleat in the toe area and by substituting specially designed peripheral cleats in the toe area, the structure and integrity of the sole is improved and the ability of the wearer to get faster starts in running on synthetic surfaces is substantially improved.

A further object of the present invention provides a cleated sole having an integrally formed peripheral flange that is specially designed for attachment by stitching or otherwise to the shoe upper. This construction is easily fabricated and is durable and relatively inexpensive to make.

SUMMARY OF THE INVENTION

To accomplish the foregoing and other objects of this invention there is provided a sole for athletic shoes which is primarily used for synthetic surfaces or turf. The sole is designed for use on football shoes and comprises a base and a first and second plurality of cleats extending from the base. First plurality of cleats are disposed relatively uniformly on the toe or ball area and in the heel area. A pluality of elongated cleats are peripherally disposed about the edge of the sole from a position on one side of the toe along one side around the heel to a second position on the other side of the toe.

Cleats that are disposed from the sole and heel areas are preferably frustoconical. The cleats that extend around the periphery of the sole are somewhat elongated. The two cleats which define the first and second position have a wedge-like ground engaging surface that tapers away from the base of the sole as they extend rearwardly, thereby defining a cam-like surface. A flange extends about the periphery of the base on the side opposite the peripheral cleat and provides means by which the sole may be secured to the upper of the footwear.

BRIEF DESCRIPTION OF THE DRAWINGS

Numerous other objects and advantages of the present invention will become more apparent upon reading the following detailed description, taken in conjunction with the accompanying drawings, in which.

DETAILED DESCRIPTION

Figures 1, 2, 3, 4:
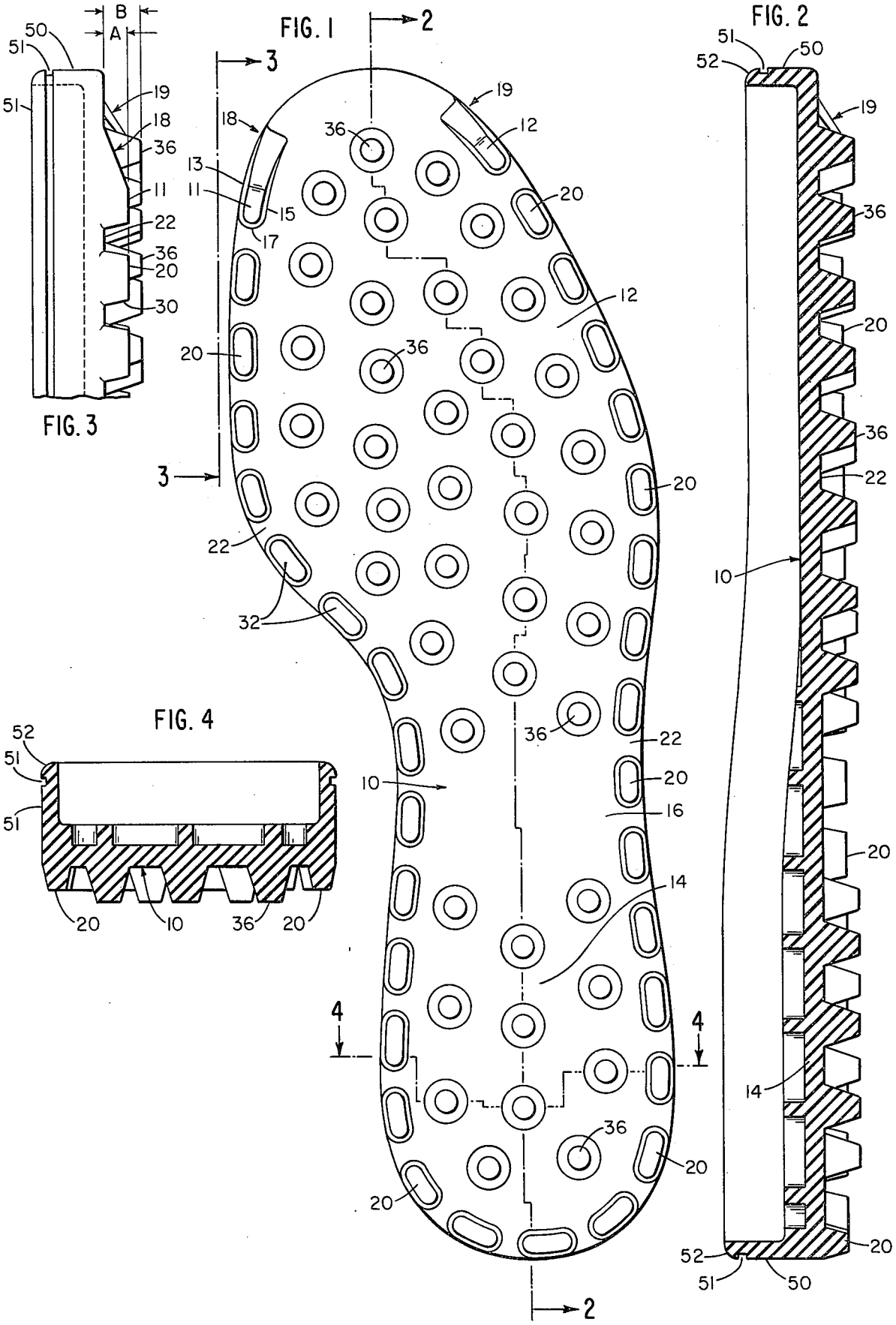
FIG. 1 is a plan view of a shoe sole embodying the present invention.
FIG. 2 is a cross-sectional view taken along the line 2—2 of FIG. 1.
FIG. 3 is a side view of the sole as taken along the line 3—3 of FIG. 1.
FIG. 4 is a cross-sectional view taken along the line 4—4 of FIG. 1.

Referring to the drawings which illustrate a preferred embodiment of the present invention there is shown a shoe sole that is designed for a variety of athletic shoes primarily used on synthetic turfs. These soles may for example, be used in football, baseball, soccer, or other kinds of athletic footwear which are ordinarily used on synthetic turf and which ordinarily are subject to substantial stresses when the wearer suddenly turns, stops or starts. The sole, however, is particularly useful for football shoes designed for synthetic turf.

As illustrated, there is provided a shoe sole formed of a single piece of flexible resilient material. This material may be formed of a suitable sole material such as relatively hard rubber or plastic that affords some degree of flexibility and resiliency and at the same time, provides enough structural strength for gripping as hereafter described. The gripping means of the sole and the general configuration of the sole may be fabricated by molding techniques well known in the art.

Referring to the drawings a sole comprises a base 10 that may be considered as being sectioned in three areas including a toe or ball area 12, a heel area 14 and a bridge area 16. The sole 10 is lined about its periphery with a plurality of somewhat elongated cleats 20 which are evenly spaced along the periphery of the sole from a first position 18 on one side of the toe area 12 along the inner side of the sole around the heel area 14 up the other side to a second position 19 on the other side of the toe area 12. This group of cleats 20 are evenly spaced from the first position 18 to the second position 18 and provide improved gripping and turning section. The two cleats 11 and 12 respectively at the first and second positions 18 and 19 are each defined by elongated inner and outer walls 13 and 15, respectively. These walls are connected by an arcuate wall 17 at the end remote from the toe end of the sole. The ends of the walls 13 and 15 closest to the toe end of the sole are tapered to the outer or lower surface of the sole thereby forming a cam or wedge-like surface that extends angularly rearwardly from the toe end of the sole.

Each of the peripheral cleats 20 has a somewhat oblong shape with a continuous tapered wall 30 that terminates in engaging surface 32 of the cleat.

Within the periphery defined by the peripheral cleats 20 are disposed a plurality of frustoconical shaped cleats 36. The majority of these cleats, which total approximately 42, are disposed in a uniform fashion in the toe or ball area 12 of the sole 10 and in the heel 14, with no cleats in the bridge or arch area 16. Most of the cleats are located in the toe area 12.

The cleats 36 and cleats 20 are of different heights. The height of the cleats 20 is represented by dimension A and the height of the cleats 36 is represented by dimension B. The (A) dimension may be, for example, 3/16 of a inch and the (B) dimension may, for example, be 5/16 of an inch. Thus, the ratio between the height of the cleats 20 and the height of the cleats 36 may be in order of magnitude of 3 to 5. This ratio may be extended to a 1 to 2 ratio.

Integrally formed with the sole on the side of the sole opposite to that of the cleats is a peripheral side wall 50, this peripheral side wall 50 is integrally formed with the sole. The side wall 50 has a thickness in the order of ⅛ of an inch and a depth in the order of ½ an inch. A channel or groove 51, parallel to the outer edge 52 and spaced approximately ¼ an inch from it extends about the entire periphery of the side wall 50. This side wall 50 is used to secure more firmly the sole to the upper of a shoe. In this connection, the sole may be stitched or cemented to the sole by suitable conventional techniques. If the sole is stitched to the upper, the stitching may pass through the groove 51 into the fabric of the upper.

What is claimed is:

1. A sole for an athletic shoe comprising, a base, a first plurality of cleats extending from the base and disposed in two groups with the cleats of each group being disposed in relatively uniformly spaced relationship, said group being disposed in the sole area and in the heel area respectively, said groups of cleats being separated by an area between the groups of said first plurality of cleats, and a second plurality of elongated cleats spaced and peripherally disposed about the edge of the sole base continuously from a first position on one side of the region of said sole rearwardly and about the heel of the sole to a second position on the other side of said toe region with the space between said first and second position spanning said toe and of a length greater than the length of the space between adjacent elongated cleats.

2. A sole for an athletic shoe as set forth in claim 1 wherein the elongated cleats defining said first and second position are each defined by inner and outer substantially parallel walls connected at the end most remote from the toe end by a transversely extending wall and at the end closest to the toe by a wall tapering to said base, thereby defining a lower ground engaging surface that is inclined rearwardly away from said base.

3. A sole for an athletic shoe as set forth in claim 1 having an annular flange extending from the periphery of said base on the side opposite and in a direction away from said second plurality of cleats, said flange having a height greater than the thickness of said base.

4. A sole for an athletic shoe as set forth in claim 3 having means forming a peripheral groove in the outer surface of said flange.

* * * * *